United States Patent [19]

Lavery

[11] Patent Number: 4,902,952

[45] Date of Patent: Feb. 20, 1990

[54] COOLING APPARATUS

[75] Inventor: Brendan Lavery, Hatfield, United Kingdom

[73] Assignee: British Aerospace Public Limited Company, London, England

[21] Appl. No.: 355,136

[22] Filed: May 17, 1989

Related U.S. Application Data

[63] Continuation of Ser. No. 168,546, Mar. 9, 1989, abandoned, which is a continuation of Ser. No. 932,556, Nov. 20, 1986, abandoned.

[30] Foreign Application Priority Data

Nov. 20, 1985 [GB] United Kingdom ..... 8528559

[51] Int. Cl.[4] ..... F25B 9/00

[52] U.S. Cl. ..... 318/645; 62/6; 60/524

[58] Field of Search ..... 318/37, 38, 51, 66, 318/85, 561, 645; 62/6; 60/520, 524; 165/104.32, 104.33

[56] References Cited

U.S. PATENT DOCUMENTS

| | | | |
|---|---|---|---|
| 3,984,831 | 10/1976 | Jones et al. | 364/817 X |
| 4,093,904 | 6/1978 | Burig et al. | 318/85 X |
| 4,417,448 | 11/1983 | Horn et al. | 62/6 |
| 4,469,993 | 9/1984 | Swanson et al. | 318/561 |
| 4,486,797 | 12/1984 | Workman | 318/561 X |
| 4,534,176 | 8/1985 | Horn ét al. | 60/520 X |
| 4,594,536 | 6/1986 | Tamagaki | 318/561 |
| 4,625,156 | 11/1986 | Komiya et al. | 318/85 |
| 4,629,954 | 12/1986 | Banzai et al. | 318/561 |
| 4,634,946 | 1/1987 | Moulds et al. | 318/561 |
| 4,675,582 | 6/1987 | Hommes et al. | 318/38 |
| 4,733,151 | 3/1988 | Butts | 318/645 |

*Primary Examiner*—Bentsu Ro

*Attorney, Agent, or Firm*—Cushman, Darby & Cushman

[57] ABSTRACT

A Stirling cycle cooling engine with separate linear motor drives for the compressor and displacer, the drives being powered by a common oscillator via respective look up table/digital to analog converter circuits and respective displacement regulating servo-loop circuits and to regulate the temperature of the element cooled by the engine, a temperature sensor arranged to control the amplitude of the compressor piston displacement.

6 Claims, 1 Drawing Sheet

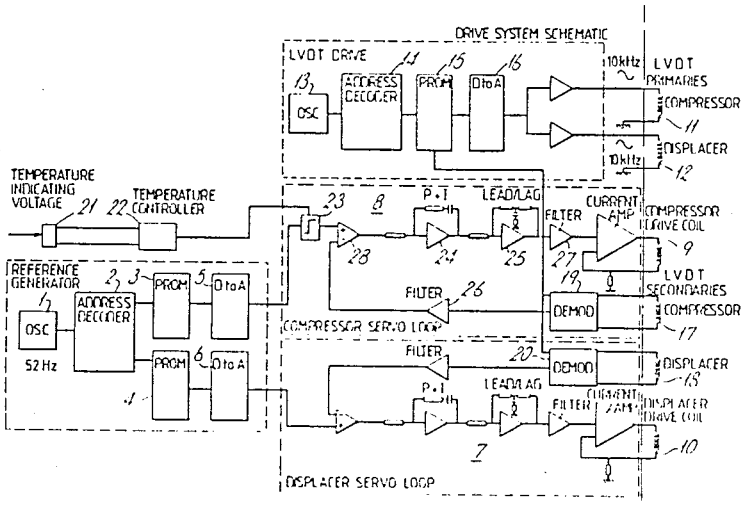

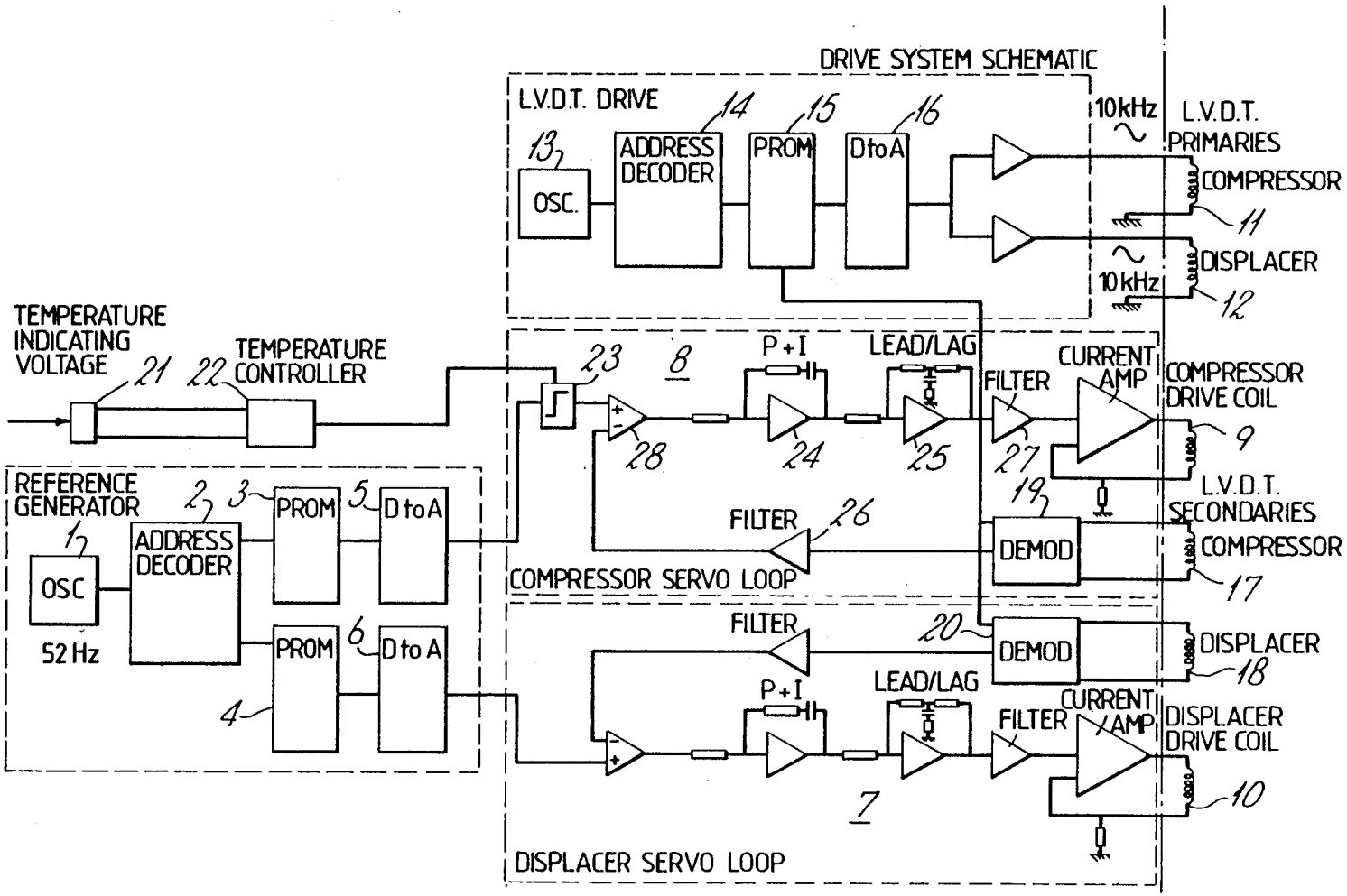
DRIVE SYSTEM SCHEMATIC
L.V.D.T. DRIVE
OSC.
13
ADDRESS DECODER
14
PROM
15
D to A
16
10kHz
L.V.D.T. PRIMARIES
COMPRESSOR
11
DISPLACER
12
10kHz
COMPRESSOR DRIVE COIL
9
CURRENT AMP
FILTER
27
LEAD/LAG
25
P+I
24
8
28
23
L.V.D.T. SECONDARIES
COMPRESSOR
17
DEMOD
19
FILTER
26
COMPRESSOR SERVO LOOP
DISPLACER
18
DEMOD
20
FILTER
P+I
DISPLACER DRIVE COIL
10
CURRENT AMP
FILTER
LEAD/LAG
7
DISPLACER SERVO LOOP
TEMPERATURE INDICATING VOLTAGE
21
TEMPERATURE CONTROLLER
22
REFERENCE GENERATOR
1
OSC
52 Hz
ADDRESS DECODER
2
PROM
3
D to A
5
PROM
4
D to A
6

COOLING APPARATUS

This is a continuation of application Ser. No. 07/168,546, filed on Mar. 9, 1989, which is a continuation of application Ser. No. 06/932,556, filed on Nov. 20, 1986. Both applications are now abandoned.

BACKGROUND OF THE INVENTION

This invention relates to a Stirling Cycle cooling engine.

As disclosed in U.S. Pat. No. 4534176, a Stirling cycle cooling engine can comprise a cold-finger containing a working fluid and a displacer which is reciprocated by a linear motor, and a pump for producing pressure variations in the fluid, the pump piston being driven by a further linear motor. For some applications it is desirable to be able to control or regulate the cooling effect of the engine and this invention has the object of providing an effective means for so doing.

SUMMARY OF THE INVENTION

According to the invention there is provided a Stirling Cycle cooling engine comprising an electromagnetically driven compressor for generating pressure variations in the working fluid of a cold finger assembly of which the displacer is also driven electromagnetically, the respective electromagnetic drives for the compressor and cold finger displacer being energised by a signal generator comprising a common oscillator, two digital memories each arranged to be addressed in dependence upon the oscillator output and containing respective output waveform sample look-up tables, two digital-to-analog converters for converting the respective memory outputs to analog form, and two servo loop circuits for receiving respective ones of said analog signals and forming respective energisation signals for the electromagnetic drives.

BRIEF DESCRIPTION OF THE DRAWINGS

Reference will now be made, by way of example, to the accompanying drawing, the single FIGURE of which is a simplified circuit diagram of a motor drive circuit for a Stirling cycle cooling engine.

DESCRIPTION OF THE INVENTION

The cooling engine comprises a compressor (not shown) of which the piston is coupled to a first drive solenoid and differential transformer position transducer, and a cold finger assembly of which the displacer is coupled to a second drive solenoid and differential transformer position transducer. The drive circuit comprises a 52 Hz oscillator 1 producing an oscillatory digital output which via decoder 2, addresses two PROM memories 3 and 4 of which the outputs are converted to analog form by converters 5 and 6.

The analog signals are fed to respective servo loop circuits 7 and 8 which drive the coils 9 of the compressor and the coil 10 of the displacer drive solenoids. Each of the servo loop circuits 7 and 8, has an associated position feedback control by means of differential transformer position transducers 11, 17, 12, 18. Circuits 24 and 25 are respectively provided for introducing a proportional plus integral term and a lead/lag term into the servo characteristic. Filters 26 and 27 and difference amplifier 28 are also provided. The function of servo loops 7 and 8 is to regulate the displacement of the compressor piston and displacer and make these displacements linearly controlled by the signals fed to the loops from the D/A converters 5 and 6, in the face of vibration, varying accelerations induced forces acting on the engine, temperature variations inducing expansion and contraction of the parts of the engine and so on. Each differential transformer position sensor has a primary and a secondary. The primaries 11 and 12 of the differential transformer position sensors are driven by an oscillator 13 via address decoder 14, look-up table PROM memory 15 and D/A converter 16 at about 10 kHz. The signals on the transducer secondaries 17 and 18 are passed to demodulators 19 and 20 respectively which each also receive a control signal from the PROM memory 15 and which use this signal to demodulate each transducer secondary signal vis a vis the primary drive signal. The demodulated transducer signals are fed into the respective servo loops 7 and 8 as shown.

The compressor drive signal is varied in dependence upon the output from a temperature transducer 21 which may comprise say a thermocouple or a diode mounted on the element to be cooled by the cooling engine. The signal from transducer 21 is fed to a controller 22 which scales and/or linerarises the signal as necessary and thereby produces a signal for controlling the gain of an adjustable gain element 23. This in turn controls the amplitude of the drive signal fed from D/A converter 5 into the compressor drive loop 8. As an alternative, the controller 22 could comprise a threshold comparator for sensing when the elements temperature has reached some predetermined value and for then switching an on-off control device fixed in place of the adjustable gain element 23. When so switched, the device simply reduces the compressor drive signal. Thus, the compressor piston/is varied to regulate the temperature of the cooled element. The transducer 21 could be coupled to the cold end of the coldfinger so as to regulate the temperature at that point rather than the cooled element directly.

The PROMs 3 and 4 contain look-up tables of drive waveform sample values. By approximately setting up the table contents any desired form of drive signal can be obtained, for example sinusoidal, sinusoidal with different magnitudes and widths of the positive and negative half cycles, sinusoidal with flattened maximum, and so on. The drive signals for the displacer and compressor can be the same or different.

I claim:

1. A Stirling Cycle cooling engine comprising:

electromagnetic drive means for electromagnetically driving a compressor for generating pressure variations in a working fluid of a cold finger assembly and for electromagnetically driving a cold finger displacer; and means for energizing the electromagnetic drive means for the compressor and cold finger displacer, comprising a common oscillator, two digital memories arranged to be addressed in dependence upon an output of the oscillator and each storing respective output waveform sample look-up tables, two digital-to-analog converters for converting respective outputs of said digital memories to analog waveforms, and two servo loop circuits for receiving respective ones of said analog waveforms and forming respective energization signals for the electromagnetic drive means based thereon.

2. A cooling engine as in claim 1 wherein said servo-loop circuits includes means for amplifying said analog waveform.

3. A cooling engine as in claim 2 further comprising means for detecting a temperature of an element to be cooled, wherein said amplifying means includes means, responsive to said temperature detecting means, for adjusting a gain of amplification, dependent thereon.

4. A cooling engine as in claim 1, further comprising means for sensing a position of at least one of said compressor and said displacer, and wherein said servo-loop circuits include means, coupled to said sensing position means, for providing a feedback indicative of a position to said servo-loop circuits.

5. A cooling engine as in claim 4 wherein said servo-loop circuits includes means for amplifying said analog waveform.

6. A cooling engine as in claim 5 further comprising means for detecting a temperature of an element to be cooled, wherein said amplifying means includes means, responsive to said temperature detecting means, for amplifying said waveform by an amount dependent on said temperature and said position.

* * * * *